US005202562A

United States Patent [19]

Koga et al.

[11] Patent Number: 5,202,562

[45] Date of Patent: Apr. 13, 1993

[54] HIGH SENSITIVE ELEMENT ANALYZING METHOD AND APPARATUS OF THE SAME

[75] Inventors: Masataka Koga; Toyoharu Okumoto, both of Katsuta; Masatoshi Kitagawa, Mito; Masamichi Tsukada, Minori; Yukio Okamoto, Sagamihara, all of Japan

[73] Assignee: Hitachi, Ltd., Tokyo, Japan

[21] Appl. No.: 724,179

[22] Filed: Jul. 1, 1991

[30] Foreign Application Priority Data

Jul. 6, 1990 [JP] Japan ..... 2-178675

[51] Int. Cl.[5] ..... H01J 49/26

[52] U.S. Cl. ..... 250/281; 250/282; 250/288

[58] Field of Search ..... 250/281, 282, 283, 286, 250/252.1 R; 436/173

[56] References Cited

U.S. PATENT DOCUMENTS 3,639,741 2/1972 Carrick ..... 250/281

4,757,198 7/1988 Korte et al. ..... 250/282

4,999,492 3/1991 Nakagawa ..... 250/281

*Primary Examiner*—Jack I. Berman

*Assistant Examiner*—Kiet T. Nguyen

*Attorney, Agent, or Firm*—Antonelli, Terry, Stout & Kraus

[57] ABSTRACT

A standard containing the same elements as a sample is prepared. Concentrations of the elements of the standard are known previously. When signal intensities of an element of the standard solution and the sample exceed an upper limit of a pulse counter of an element analyzing apparatus, a transmitting rate of a passage, through which ionized elements of the standard and the sample pass, is controlled to be less than the ordinal transmitting rate of the passage in synchronism to the passing time of the elements. The concentrations of the elements of the sample is calculated based on output signals of the pulse counter concerning the elements of the standard and the sample and known concentration of the standard.

15 Claims, 4 Drawing Sheets

HIGH SENSITIVE ELEMENT ANALYZING METHOD AND APPARATUS OF THE SAME

FIELD OF THE INVENTION

The present invention relates to an element analyzing apparatus for measuring concentration of elements. More specifically, the present invention relates to a high sensitive element analyzing method and an apparatus of the same which are able to measure the concentration in a wide dynamic range from a low concentration to a high concentration of samples solutions.

BACKGROUND OF THE INVENTION

As a general element analyzing apparatus using a mass spectrometer, an inductively coupled plasma mass spectrometer (hereunder ICP/MS) can be given as a representative example. Concerning the ICP/MS, there are two publications such as Analytical Chemistry, Vol. 58, No. 1, January 1986 pages 97A to 105A and entitled "Mass spectrometry of inductively coupled plasmas" and "The origins, realization and performance of ICP-MS systems", pages 1 to 42 of "Applications of Inductively coupled plasma mass spectrometry" published 1989 by Blackie and Son Ltd.

There is a discussed example using not ICP but a microwave induce plasma (hereunder MIP) as an ion source on FIG. 1 of Japanese Patent Laid-Open No. 1-283745 published on Nov. 15, 1989 and entitled "Microwave induced plasma generation apparatus".

In each prior art mentioned above, a sample solution is dissociated, atomized and ionized by high temperature plasma, each element is selected using a mass spectrometer and each ion is detected by a secondary electron amplifier.

Although a detection limit value of an optical measuring apparatus such as atomic absorption spectrophotometer or ICP emission spectophotometer is in sub-ppb level (1 ppb$=10^{-9}$ g/ml), there has been reported that a detection limit value of the ICP/MS is in ppt level (1 ppt$=10^{-12}$ g/ml). For attaining the high sensitivity, there has been used a pulse counting method which counts numbers of ion reached to a secondary electron multiplier. In the pulse counting method, when an ion current exceeds a threshold value which is previously determined, it is recognized that the ion reaches to the secondary electron multiplier and after that the numbers of ion are counted. Accordingly, a dark current, namely background counting value, is able to be suppressed lower so that high sensibility of counting concentration of the sample solution can be realized.

The ICP/MS and MIP/MS which use the pulse counting method aim at chiefly the high sensitivity so that they are proper to measure a low concentration sample solution. However, they are not proper to measure a high concentration sample solution.

Because, an upper limit of the pulse limit of the pulse counting method is $10^6$ counts/sec. When the ion reaches at a period which exceeds the upper limit, the secondary electron multiplier is saturated so that the multiplier can not count correctly the ion numbers.

More specifically, the background of the ICP/MS and MIP/MS are in the order of 1 cps, the standard dynamic ranges of them are $10^6$ cps. When the upper limit value of them is 1 ppt, the quantitative measurement of them is 1 ppt$-$1 ppm (ppm$=10^{-6}$ g/ml). The dynamic range of $10^6$ cps is not inferior to a quantitative measurement by other analyzing method. The ICP/MS and MIP/MS are able to measure many elements at the same time. When an element of high concentration level more than 1 ppm is measured, the element exceeds a quantitative dynamic range so that the element can not obtain quantitative results by one measurement.

Conventionally, when a high concentration element, which exceeds the dynamic range, were analyzed using the ICP/MS and MIP/MS, the sample solution was diluted to be less than 1 ppm and measured again.

Recently, for excluding a time required for diluting the sample solution, a secondary ion analyzing apparatus is arranged in such a manner that an attenuator for lowering a transmitting rate of the secondary ion is provided in a passage of the secondary ion outputted from the mass spectrometer and then the attenuator is connected to the electron multiplier as shown in FIGS. 1 and 2 of Japanese Patent Laid-Open No. 63-193452 published on Aug. 10, 1988 and entitled "Secondary ion mass spectrometer". Japanese Patent Laid-Open No. 64-45050 published on Feb. 17, 1989 and entitled "Secondary ion mass spectrometer" discloses in FIGS. 5, 7 and 8 that an attenuator for lowering the current density of the secondary ion is provided and the measure current density is divided by the ion attenuation rate of the attenuator so that the measured dynamic range is enlarged. Namely, when the level of the element of the sample solution exceeds above the ordinal dynamic range on account of the high concentration level, the quantitative limit results are raised without lowering the detective limit value by lowering the transmitting rate of the passage to the ion detector.

In the case of attenuating the transmitting rate of the secondary ion as shown in the conventional method, the mass spectrometer of the prior arts took place the quantitative measurement using the absolute value of the transmitting rate. According to the method mentioned above, when the transmitting rate is changed or the transmitting rate of the ion attenuator is changed with the passage of time, an error is caused to the quantitative measurement. Although there is necessity to know exactly the absolute value of the transmitting rate, catching and maintaining of the transmitting rate are very difficult.

SUMMARY OF THE INVENTION

An object of the present invention is to provide an element analyzing method and an apparatus of the same which is able to measure a concentration of a sample solution very simply and accurately and have reliability, when the concentration of the sample solution is measured from a low concentration to a high concentration by controlling a transmitting rate of the sample solution.

For attaining the object, the present invention proposes three methods as follows as following method:

The First Method

When there is an element having a high concentration level which exceeds an upper limit of a pulse counter of the element analyzing apparatus within the sample solution, a transmitting rate of an ion passage which is located from the ionized sample solution to a secondary electron multiplier is lowered, the element of the sample solution and an element of a standard solution containing a same class solution as the sample solution and having a known concentration of the element are detected, respectively, by the secondary electron multiplier, and the concentration of the element of the sample solution is calculated based on the pulse counts of the element of both the standard solution and the sample solution and the known concentration of the standard solution.

As the method of ionizing the element, there are methods such that each element constituting the sample solution is dissociated using a plasma as ICP/MS and MIP/MS to ionize elements, and the sample solution is implanted by the first ion to generate the secondary ion.

The Second Method

The second method is same as the first method fundamentally. The second method is different from the first method in that the second method is not limited to the pulse counting method for detecting the ionized element, but applied to a current measuring method.

When there is an element having a high concentration level which exceeds a saturated output of the ion detector within the sample solution, the second method is carried out by the same analyzing method as the first method.

The Third Method

The third method relates to an apparatus for carrying out the above-mentioned analyzing methods. The present invention proposes a high sensitive element analyzing apparatus comprising a structure having a function for controlling variably a transmitting rate of a passage from an ionization source to an ion detector, and means for calculating a concentration of an element of the sample solution based on pulse counts and a known concentration of a standard solution, when the element of the sample solution and an element of the standard solution having the same element as the sample solution are detected in the same transmitting rate.

Hereunder, we will explain the operation of the apparatus according to the first or second method. The ionized element within the sample solution is selected as each measuring element having a respective mass number and reaches to a secondary electron multiplier or an ion detector. When a concentration of an element of the sample solution is within an ordinal dynamic range, namely below an upper limit of a pulse count of an ion detector, a transmitting rate of a passage to the ion detector is controlled to be a normal transmitting rate, for instance the maximum transmitting rate for carrying out the high sensitive analyzing in the condition.

When a concentration of the element of the sample solution exceeds the ordinal dynamic range, the transmitting rate is controlled to be lowered corresponding to the concentration. For instance, the transmitting rate is controlled to be $10^{-2}$ to $10^{-3}$ of the maximum transmitting rate.

The standard solution contains an element of a known concentration of the same class as the element of the sample solution corresponding to the concentration level of the sample solution.

When the concentration of the element of the sample solution exceeds the ordinal dynamic range, the element of the sample solution and an element having a known concentration of the standard solution which belongs to the same class as the sample solution are transmitted under the same transmitting rate, implanted to the secondary electron multiplier or the ion detector, and ion numbers of them are detected by the pulse counter. The concentration of the element of the sample solution is calculated based on a ratio of the pulse counts of each ionized element of the standard solution and the sample solution, and the known concentration of the standard solution.

According to the analyzing method of the present invention, the measuring dynamic range can be enlarged by controlling variably the transmitting rate. Since the concentration measurement of the present invention is calculated based on the relative ratio of the counted pulses of the same ionized element of the standard solution and the sample solution, and the known concentration of the standard solution in place of an absolute value of a transmitting rate as in the conventional method, and the relative ratio and the known concentration can be obtained easily and maintained without a change with the passage of time, the present invention can enhance the measuring accuracy with high concentration level.

Hereunder, we will explain the operation of the apparatus according to the third method. For realizing the operation of the present invention, a variable control device of the transmitting rate and a calculation device for calculating the concentration of the element of the sample solution based on the relative ratio of the pulse counts and the known concentration. The calculation device comprises, for instance, a computer.

DETAILED DESCRIPTION OF THE PREFERRED EMBODIMENT

Figure 1:
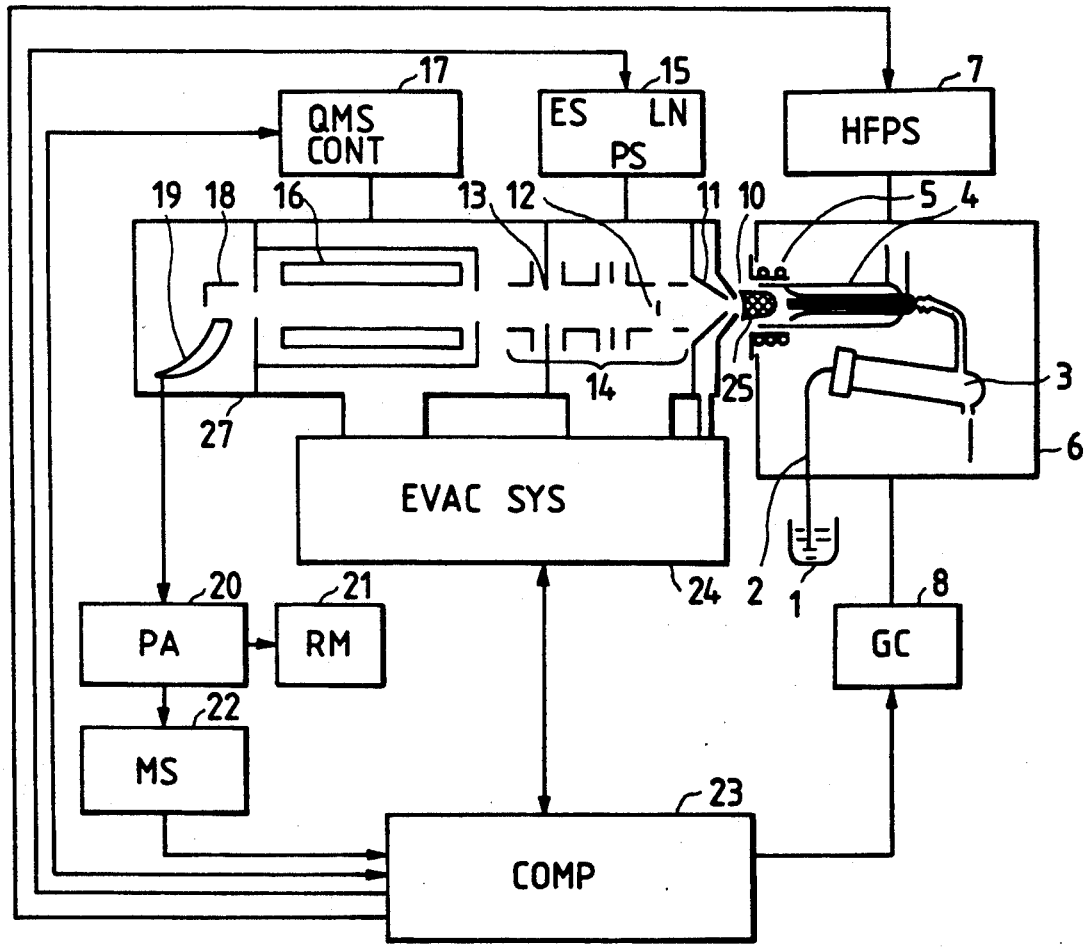
FIG. 1 shows a block diagram of high sensitive element analyzing apparatus applied to the present invention.

FIG. 1 shows a block diagram of a high sensitive element analyzing apparatus using the ICP/MS applied to an embodiment of the present invention.

Referring to FIG. 1, a sample solution 1 is conducted to a spray chamber 3 through a capillary tube 2. The sample solution is sprayed at the spray chamber 3. For spraying the sample, a pneumatic nebulizer is used in many cases. A gas for spraying the sample solution is supplied from a gas controller 8. The sprayed sample solution is introduced to a discharge tube 4 by a carrier gas. The top end of the discharge tube 4 is wound by a high frequency coil 5. A high frequency power is applied from the high frequency power source 7 to the high frequency coil 5 to produce a plasma 25. The solvent of the sprayed sample solution is vaporized, dissociated and atomized, and further ionized within the plasma 25. The high frequency coil 5 is provided within a shielded box (ionizer) 6 for avoiding the leakage of the electromagnetic wave. The ion produced by the plasma 25 is conducted to a vacuum chamber 27 through orifices of a sampler 10 and a skimmer 11. The ion is introduced to a mass spectrometer 16 through electrostatic lenses 14 and an aperture 13. Numeral 24 denotes a evacuation system of the vacuum chamber 27. A photon stopper 12 is provided within the electrostatic lenses 14 for preventing the photon of the plasma 25 from entering to a secondary electron multiplier 19. The voltage of the electrostatic lenses 14 is supplied from a lenses power source. In the embodiment, a quadrupole mass spectrometer 16 is used as the mass spectrometer. Either one of mass spectrometer of double focusing type, using ion cyclotron resonance phenomenon or ion trap type can be used instead. The quadrupole mass spectrometer 16 is controlled by a quadrupole mass spectrometer controller 17. The ionized elements passed through the electrostatic lenses 14 are selected in each mass number. The ions of the elements to be measured pass through the mass spectrometer, are reflected by a reflection electrode and entered to a secondary electron multiplier 19. The ions entered to the secondary electron multiplier 19 are counted one by one using the pulse counting method for attaining the high sensitive analysis. Concretely, the ion signals entered to the secondary electron multiplier are amplifier as pulses by a pre-amplifier 20, carried out the wave rectification and counted by a multichannel scaler 22. The pre-amplifier 20 has a function of discrimination and counts pulses which exceed a threshold level. By the function of the discrimination, the background level is lowered to attain the high sensitivity. By connecting a rate meter 21 to the pre-amplifier 20, frequencies of pulses can be monitored analogously.

The total system of the apparatus is controlled and carried out signal processing by a computer 23. The pulse counted values by the multichannel scaler 22 are classified in each element to be measured, namely in each ion having a selected mass number and inputted to memories of the computer 23. The computer 23 has a function of calculating the pulse counted values into concentrations of elements of the sample solution as mentioned later.

Figure 2:
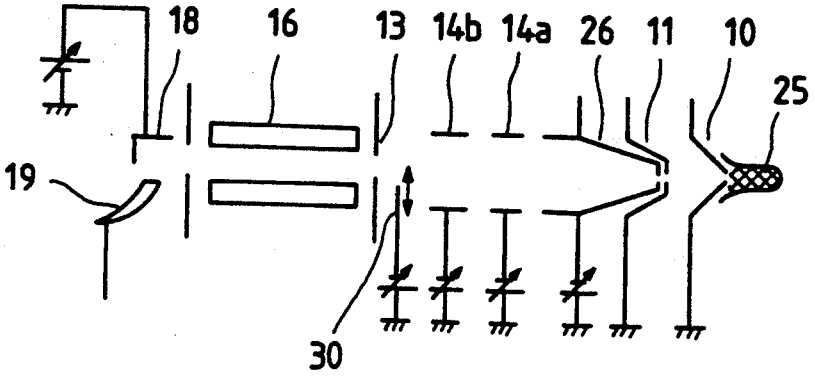
FIG. 2 shows a detail of an ion passage between an ionizer and a secondary electron multiplier.

Referring to FIG. 2, the ions made from the plasma 25 is introduced to the vacuum chamber 27 from the sampler 10. An extraction electrode 26 is provided approaching to the skimmer 11 and has a role of extracting ions between the sampler 10 and the skimmer 11. The applied voltage of the extraction electrode 26 is variable. The electrostatic lenses 14 comprise the first electrostatic lens 14*a* and the second electrostatic lens 14*b*. These electrostatic lenses 14*a* and 14*b* focus the ion beam to the entrance aperture 13 of the mass spectrometer. Although the photon stopper 12 is omitted in FIG. 2, it is provided, if necessary.

For attaining a high sensitive measurement, it is demanded that the condition of the plasma 25 is set in optimum, the ions are introduced to the vacuum chamber 27, the mass spectrometer 16 and further the secondary electron multiplier 19 effectively.

The extraction electrode 26 has a role of extracting electrostatically the ions passed through the sampler 10. There is a predetermined relation between the applied voltage to the extraction electrode 26 and the mount of passed ions depending on the shapes of the sampler 10 and the skimmer 11, the shape of the extraction electrode and the degree of vacuum at the chamber 27.

In the embodiment, the ions amount passing from the ionizer 6 to the secondary electron multiplier 19 is made maximum, namely the transmitting rate of ions between the ionizer to the secondary electron multiplier is made maximum, for attaining the high sensitivity at the region of the ordinal dynamic range (the region which does not exceed the upper limit of the pulse counts by the multichannel scaler 22, in other words the region which does not exceed the saturated output of the secondary electron multiplier 19). When an element to be measured is in a high concentration level which exceeds the measuring dynamic range, the passing ion amount, namely the transmitting rate of ions is lowered corresponding to the concentration level of the element.

The above-mentioned variable control of the transmitting rate is carried out by the following four methods.

1. The voltage applied to the extraction electrode 26 for extracting the ions from the ionizer 6 toward the vacuum chamber 27 is controlled variably.
2. The voltages applied to the electrostatic lenses 14*a* and 14*b* are controlled variably as disclosed in Japanese Patent Laid-Open No. 64-45050. When the electrostatic lenses 14*a* and 14*b* focus the ion beam to the aperture 13, the transmitting rate becomes maximum. When the focus is out of the aperture 13, the transmitting rate is lowered. By varying the applied voltage to the electrostatic lenses, the transmitting rate is controlled variably.
3. By varying the diameter of the aperture 13 variably, the transmitting rate is lowered.
4. The voltage applied to the reflection electrode 18 is controlled variably. The reflection electrode changes the progress direction of the ion beam to conduct the ion beam to the secondary electron multiplier 19. By adjusting the voltage applied to the reflection electrode 18, the ion beam is entered partially to the secondary electron multiplier 19.

By inserting an interfering electrode 30 to the ions passage for interfering the passage of the ions, the transmitting rate is also controlled. At first, the efficiency of the transmitting rate of the ion passage is made maximum before the interfering electrode is inserted. The ions beam is bent by the insertion of the interfering electrode so as to enter the ion beam partially to the secondary electron multiplier 19. These controls are carried out by the computer 23.

Figure 3:
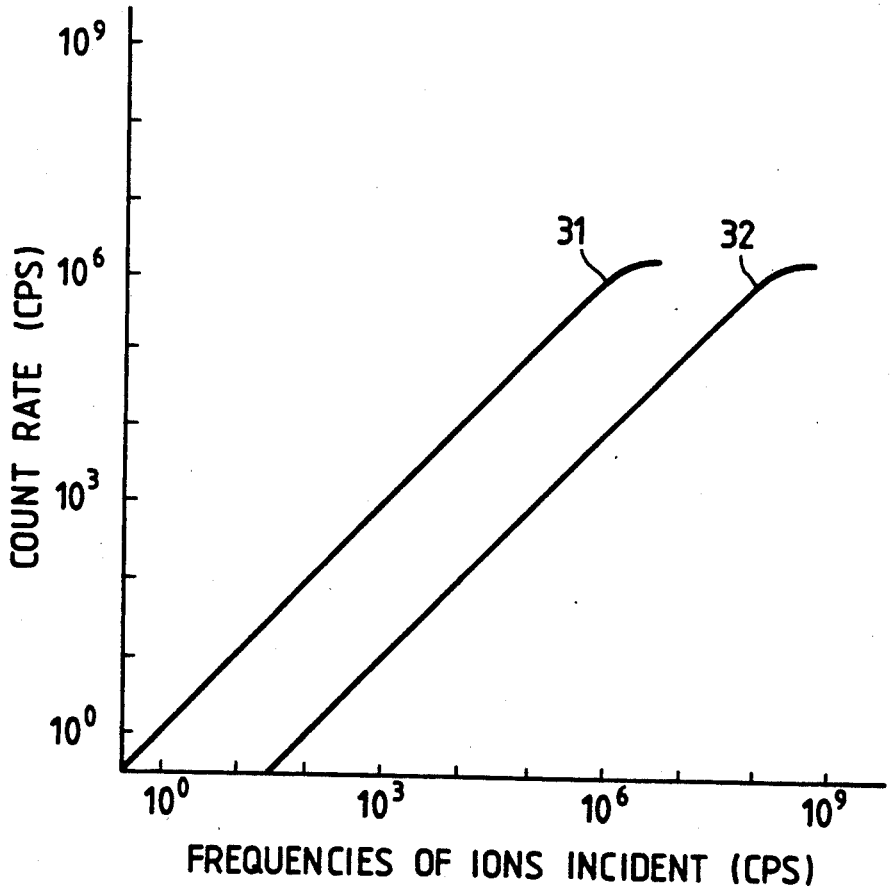
FIG. 3 shows a characteristic diagram between frequencies of ions incident and counter rate, when a transmitting rate is controlled.

Referring to FIG. 3, the characteristic curve 31 shows that the transmitting rate is maximum. When the frequencies of ions incident exceed $10^6$ cps in the characteristic curve 31, the output of the secondary electron multiplier 19 is saturated so that the total numbers of the ions are not counted correctly. The characteristic curve 32 shows that the transmitting rate is lowered $10^{-2}$ times in the frequencies of ions incident. In the characteristic curve 32, the linear characteristic is obtained by $10^8$ cps of the frequencies of ions incident.

By using either the characteristic 31 or the characteristic 32, the measuring dynamic range can be enlarged by $10^2$ times of the frequencies of ions incident. In other words, the concentration of the sample can be enlarged from 1 ppt to 100 ppm using the characteristics shown by the curves 31 and 32.

The concentration calculation of the pulse count rate is carried out by the computer 23 in the case of the transmitting rate is controlled variably.

Hereunder, we will explain the concentration calculation based on the actual measuring sequence referring to FIGS. 4A to 4D.

Figure 4A:
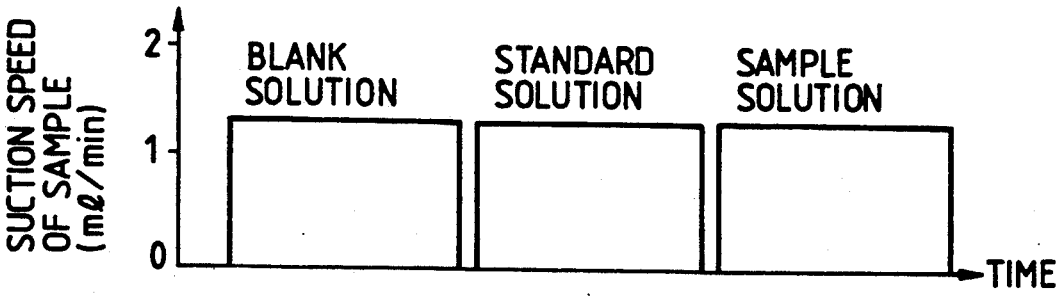
FIG. 4A shows a measuring order which is taken place in the present invention.
Figure 4B:
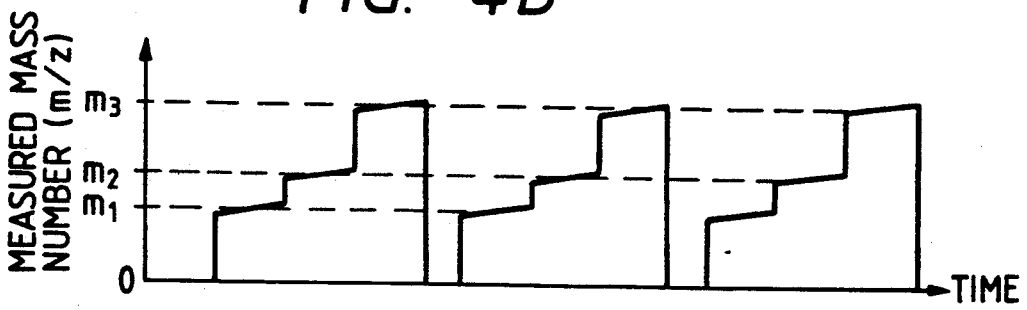
FIG. 4B shows selective scanning of elements having different mass numbers to be measured using a mass spectrometer.
Figure 4C:
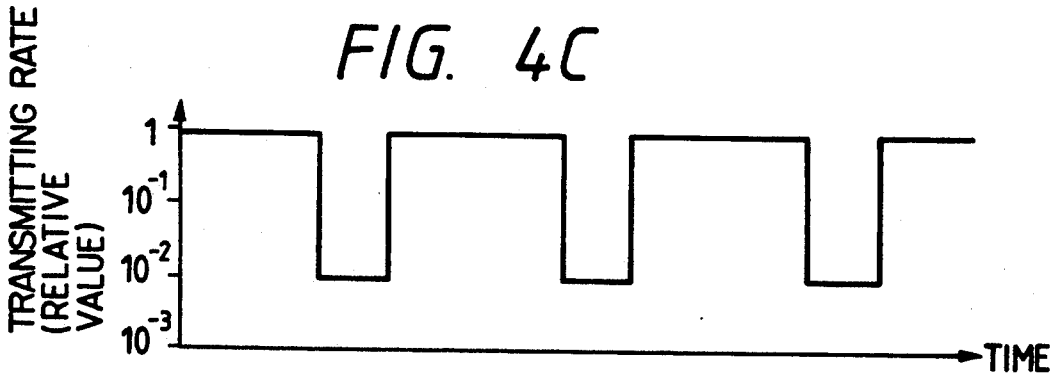
FIG. 4C shows a diagram in which a transmitting rate is controlled corresponding to each element concentration synchronizing to the selective scanning of elements to be measured shown in FIG. 4B.

In the embodiment shown in FIGS. 4A, 4B and 4C, the sample solution contains elements to be measured having different mass numbers, respectively. The mass numbers of the elements are $m_1$, $m_2$ and $m_3$, and the two elements having the mass numbers $m_1$ and $m_3$ are in the concentration level within the ordinal dynamic range, for instance 1 ppt to 1 ppm. Concerning the element of the mass number $m_2$, it is known that the element is in the high concentration level which exceeds 1 ppm. When the concentration level of each element is not known, all the summary concentration values of the elements have to be measured previously.

In the embodiment, the standard solution containing the same classes elements of the mass numbers $m_1$, $m_2$ and $m_3$ as the sample solution and having known concentrations relating to all the elements of the standard solution and a blank solution are prepared.

Referring to FIG. 4A, the measurement is carried out in the order of a blank solution, the standard and the sample solution. Suppose that the element having the mass number $m_2$ is known to have a high concentration level which exceeds an ordinal dynamic range. The transmitting rate of the element having the mass number $m_2$ is controlled to a low sensitivity, for instance $10^{-2}$, when it is measured. Concerning other elements having mass numbers of $m_1$ and $m_3$, the transmitting rate for them are controlled to the maximum of 1, when they are measured. As mentioned above, the transmitting rate are controlled variably in order corresponding to the concentration levels of the elements to be measured of the sample solution and the known concentrations elements of the standard solution. In synchronism with the variable control of the concentrations, the elements to be measured of the sample solution and the known concentrations elements of the standard solution are passed through the mass spectrometer 16.

Figure 4D:
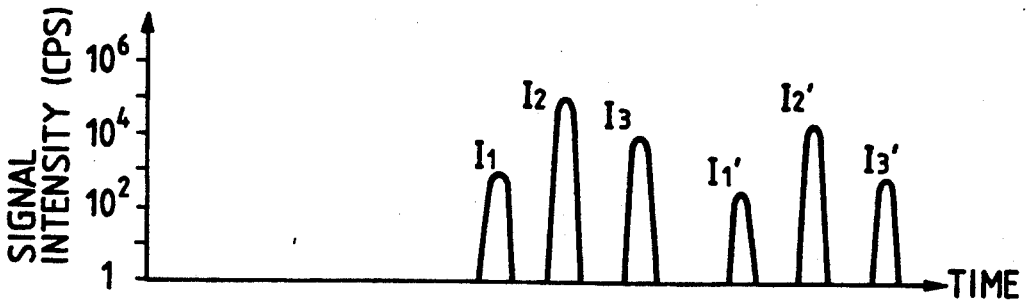
FIG. 4D shows signal intensity of each ionized element when ion numbers are detected under the condition of the transmitting rate shown in FIG. 4C.

Referring to FIG. 4D, the counter rate of the blank solution is less than 1 cps concerning the three elements having the mass numbers of $m_1$, $m_2$ and $m_3$, respectively. The counter rates of the standard solution and the sample solution are $I_1$, $I_2$, $I_3$ and $I_1'$, $I_2'$, $I_3'$ concerning the three elements, respectively. The signal intensities of $I_2$ and $I_2'$ concerning the both solutions elements having the mass number $m_2$ are $10^5$ cps approximately. If the transmitting rate is not lowered in the degree of $10^{-2}$ when the element having the mass number of $m_2$ is measured, the counter rates of the element exceed more than $10^6$ cps. The signal intensities $I_1$, $I_3$ and $I_1'$, $I_3'$ of the standard solution and the sample solution concerning the mass numbers $m_1$, $m_3$ are less than $10^6$ cps, when the transmitting rate are controlled to the maximum of 1.

The computer 23 inputs the known concentrations $C_1$, $C_2$, $C_3$ relating to the elements having the mass numbers $m_1$, $m_2$, $m_3$ of the standard element and the signal intensities of $I_1$, $I_2$, $I_3$ and $I_1'$, $I_2'$ $I_3'$ of the above-mentioned counter rates, and calculates the concentrations of the sample solution.

When the signal intensities of the three elements are $I_1'$, $I_2'$ and $I_3'$, the concentrations $C_1'$, $C_2'$ and $C_3'$ of the elements having the mass numbers of $m_1$, $m_2$ and $m_3$ are calculated as follows.

$$C_1' = C_1 \cdot \frac{I_1'}{I_1}$$

$$C_2' = C_2 \cdot \frac{I_2'}{I_2}$$

$$C_3' = C_3 \cdot \frac{I_3'}{I_3}$$

Figure 5A:
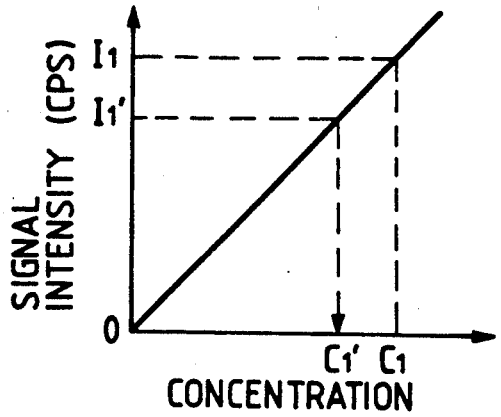
FIGS. 5A, 5B and 5C show the method for obtaining concentrations $C_1'$, $C_2'$ and $C_3'$ corresponding to signal intensities $I_1'$, $I_2'$ and $I_3'$ of the sample according to linear equations shown by FIGS. 5A, 5B and 5C, respectively.
Figure 5B:
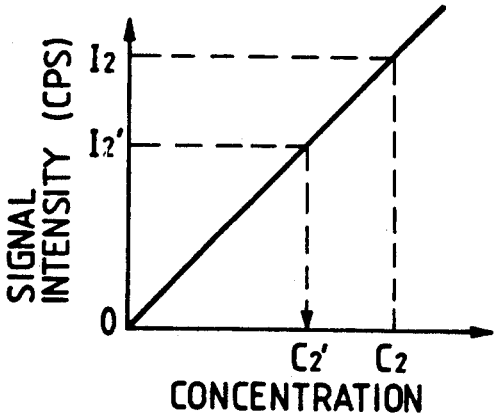
Figure 5C:
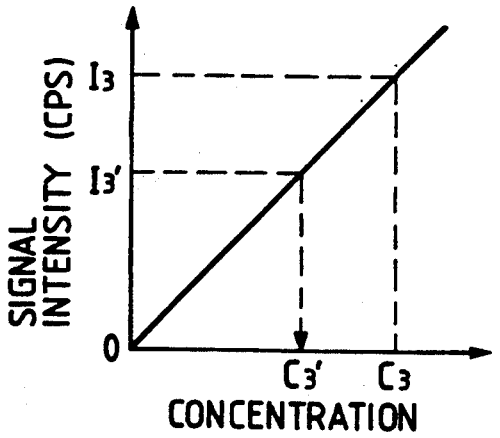

In FIGS. 4 and 5, the number of the standard is 1. However, the number of the standard solution is not limited to 1. In this case, an approximation of the calibration curve is not limited to a linear equation. The numbers of elements to be measured are not limited to 3. When the concentration levels of the measuring elements are within the dynamic range, the concentrations of the elements of the sample solution is calculated directly from the pulse count rates of the elements of the sample solution without comparing the known concentration elements of the standard solution with the signal intensities.

According to the present invention, the absolute value of the transmitting rate is not demanded to be very accurate in the case that the measuring dynamic range is enlarged by controlling variably the transmitting rate. The present invention can measure the concentrations correctly based on the relative ratio of the outputted signals of the ionized elements of the sample solution and the standard solution, and the known concentration values of the standard element so that the enlargement of the measuring dynamic range and increment of the measuring accuracy can be attained.

What we claim is:

1. An analyzing method for detecting ionized elements of a sample which are transmitted through a mass spectrometer by a secondary electron multiplier and for counting the number of ionized elements reaching the secondary electron multiplier using a pulse counter so as to detect a concentration of the sample comprising the steps of:

decreasing a transmitting rate of the ionized elements through the mass spectrometer by a predetermined value when the concentration of the ionized elements is above a measuring range, detecting said ionized elements of said sample and ionized elements of a standard having a known concentration by said secondary electron multiplier, and calculating said concentration of said sample based on the detected ionized elements of said standard and said sample and the known concentration of said standard.

2. A method according to claim 1, wherein the sample is a sample solution and the ionization of said elements of said sample solution comprises:

a step of dissociating atoms which constitute said sample solution.

3. A method according to claim 1, wherein said step of decreasing the transmitting rate comprises a series of variable controlling of said transmitting rate corresponding to a concentration level of said ionized elements of said sample and said ionized elements of said known concentration of said standard, when said sample comprises a number of ionized elements having different mass numbers, respectively, and at least one concentration of the ionized elements of said sample is above an upper limit of said measuring range of said pulse counter, and said step of detecting the ionized elements of said sample and the ionized elements of said standard passes selectively said ionized elements of said sample and said ionized elements having the known concentrations of said standard to said ion passage through said mass spectrometer in synchronism with the variable controlling of said transmitting rate.

4. A method according to claim 1, wherein said sample is either one of a fluid, a gas or a solid.

5. An analyzing method for detecting ionized elements of a sample which are transmitted through a mass spectrometer by an ion detector and for counting the number of ionized elements reaching a secondary electron multiplier using a pulse counter so as to detect a concentration of the sample comprising the steps of:

decreasing a transmitting rate of the ionized elements through the mass spectrometer by a predetermined value when the concentration of the ionized elements is above a measuring range, detecting said ionized elements of said sample and ionized elements of a standard having a known concentration by said ion detector, and calculating said concentration of said sample based on the detected ionized elements of said standard and said sample, and the known concentration of said standard.

6. A method according to claim 5, wherein the sample is a sample solution and the ionization of said element of said sample solution comprises:

a step of dissociating atoms which constitute said sample solution.

7. A method according to claim 5, wherein said step of decreasing the transmitting rate comprises a series of variable controlling of said transmitting rate corresponding to a concentration level of said ionized elements of said sample and said ionized elements of said known concentration of said standard, when said sample comprises a number of ionized elements having different mass numbers, respectively, and at least one concentration of the ionized elements of said sample is above an upper limit of said measuring range of said pulse counter, and said step of detecting the ionized elements of said sample and the ionized elements of said standard passes selectively said ionized elements of said sample and said ionized elements having the known concentrations of said standard to said ion passage through said mass spectrometer in synchronism with the variable controlling of said transmitting rate.

8. A method according to claim 2, wherein said sample is either one of a fluid, a gas or a solid.

9. An analyzing apparatus comprising:

means for ionizing elements of a sample, ion detecting means for detecting and counting the number of said ionized elements which is conducted through a mass spectrometer, control means for decreasing a transmitting rate of said ionized elements through said mass spectrometer by a predetermined value when a concentration of said sample is above a measuring range, and means for calculating said concentration of said sample based on the counted number of said ionized elements of said sample and ionized elements of a standard having a known concentration and said known concentration of said standard.

10. An analyzing apparatus according to claim 9, wherein said control means comprises means which controls either an applied voltage of an extraction electrode provided within a vacuum chamber for extracting said ion from an ionizer of said sample to the vacuum chamber or a voltage of an electrostatic lens within the vacuum chamber.

11. An analyzing apparatus according to claim 9, wherein said control means comprises means for controlling a reflection electrode provided at an ion passage located between said sample and said ion detecting means.

12. An analyzing apparatus according to claim 9, wherein said control means comprises means for controlling a magnet provided at an ion passage located between said sample and said ion detecting means.

13. An analyzing apparatus according to claim 9, wherein said control means comprises means for controlling an insertion of an interfering electrode provided at an ion passage located between said sample and said ion detecting means.

14. An analyzing apparatus according to claim 9, wherein said control means comprises means for controlling more than two applied voltages among an ion extraction electrode, an electrostatic lens, a reflection electrode and an interference electrode which are provided at an ion passage located between said sample and said ion detecting means.

15. An analyzing apparatus according to claim 9, wherein said control means comprises means for controlling a diameter of an aperture provided at an ion passage located between said solution and said ion detecting means.

* * * * *